US008348342B2

(12) United States Patent
Golynsky et al.

(10) Patent No.: US 8,348,342 B2
(45) **Date of Patent: *Jan. 8, 2013**

(54) PREFERENCE CONTROL MECHANISM

(75) Inventors: Arkady Golynsky, Allentown, PA (US); Gregory Allison, Orefield, PA (US)

(73) Assignee: Knoll, Inc., East Greenville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/406,669

(22) Filed: Feb. 28, 2012

(65) Prior Publication Data

US 2012/0153693 A1 Jun. 21, 2012

Related U.S. Application Data

(63) Continuation of application No. 12/478,090, filed on Jun. 4, 2009, now Pat. No. 8,172,324.

(60) Provisional application No. 61/059,434, filed on Jun. 6, 2008.

(51) Int. Cl.
*A47C 1/032* (2006.01)

(52) U.S. Cl. ..... 297/303.1; 279/300.2; 279/300.4; 279/303.3

(58) Field of Classification Search ..... 297/300.1, 297/300.2, 300.3, 300.4, 300.5, 302.1, 302.2, 297/302.3, 302.4, 303.1, 303.3
See application file for complete search history.

(56) References Cited

U.S. PATENT DOCUMENTS

| | | | |
|---|---|---|---|
| 4,865,384 | A | 9/1989 | Desanta |
| 4,889,384 | A | 12/1989 | Sulzer |
| 5,080,434 | A | 1/1992 | Locher |
| 5,106,157 | A | 4/1992 | Nagelkirk et al. |
| 5,192,114 | A | 3/1993 | Hollington et al. |
| 5,370,445 | A | 12/1994 | Golynsky |
| 5,385,388 | A | 1/1995 | Faiks et al. |
| 5,388,889 | A | 2/1995 | Golynsky |
| 5,499,861 | A | 3/1996 | Locher |
| 5,772,282 | A | 6/1998 | Stumpf et al. |
| 5,909,924 | A | 6/1999 | Roslund, Jr. |
| 5,971,481 | A | 10/1999 | Emmenegger et al. |

(Continued)

FOREIGN PATENT DOCUMENTS

| | | |
|---|---|---|
| EP | 1358821 | 11/2003 |
| WO | 9816138 | 4/1998 |
| WO | 0228228 | 4/2002 |
| WO | 2008041868 | 4/2008 |

OTHER PUBLICATIONS

International Search Report and Written Opinion of the International Searching Authority for PCT/US2009/046419, dated Sep. 11, 2009.

*Primary Examiner* — Peter R. Brown
(74) *Attorney, Agent, or Firm* — Buchanan Ingersoll & Rooney PC

(57) ABSTRACT

A preference control mechanism is provided that includes a housing, a shuttle, a sub shuttle and at least one resilient member. The housing has a channel. The shuttle has a cavity. The shuttle is moveable within the channel of the housing from a first position to at least one second position. The sub shuttle is moveable within the channel of the housing and is moveable independent of the shuttle. The one or more resilient members have a first end and a second end opposite the first end. The first end is attached to the shuttle and the second end is attached to the sub shuttle. The preference control mechanism is configured for attachment to at least one chair component. Chairs may also be designed to include one or more embodiments of the preference control mechanism.

19 Claims, 8 Drawing Sheets

U.S. PATENT DOCUMENTS 6,019,429 A 2/2000 Tedesco
6,213,552 B1 4/2001 Miotto
6,349,992 B1 2/2002 Knoblock et al.
6,588,843 B1 7/2003 Ebenstein
6,733,080 B2 5/2004 Stumpf et al.
6,742,843 B2 6/2004 Golynsky
6,796,611 B2 9/2004 Bock
6,869,142 B2 3/2005 Heidmann et al.
6,871,909 B2 3/2005 Hobb et al.
6,913,315 B2 7/2005 Ball et al.
6,932,430 B2 8/2005 Bedford et al.
6,957,862 B2 10/2005 Chen
7,147,285 B2 12/2006 Lin
7,784,870 B2 8/2010 Machael et al.

PREFERENCE CONTROL MECHANISM

CROSS-REFERENCE TO RELATED APPLICATION

The present application is a continuation application of U.S. patent application Ser. No. 12/478,090, which claimed priority to U.S. Provisional Patent Application Ser. No. 61/059,434.

FIELD OF THE INVENTION

The present invention relates to chairs, particularly preference control mechanisms for chairs.

BACKGROUND OF THE INVENTION

Preference control mechanisms for use in adjusting the force required to tilt back a chair or tilt or rotate other chair components are often included in various chairs. For example, preference control mechanisms are disclosed in U.S. Pat. Nos. 4,865,384, 4,889,384, 5,106,157, 5,192,114, 5,370,445, 5,385,388, 5,388,889, 5,909,924, 6,742,843 and 6,932,430.

Chair tilt controls often utilize a spring that acts on a backrest to bias the backrest to an upright position. Some types of preference control mechanisms are configured so that a user may select a desired preference setting for the force provided by this spring. Such preference controls can permit heavy weighted users to adjust the force required to tilt a backrest to a reclined position so that the heavy user may experience the same recline ride as a lighter user. Such preference controls may also permit users to select the biasing force that provides a preferred recline ride. For instance, a lighter user may prefer a first setting that permits a relatively weak biasing force to act on the backrest. The preference control may be configured to permit a heavier user to adjust the biasing force exerted by the spring of the chair tilt mechanism so that a greater force acts on the back to bias the back to an upright position so recline of the backrest requires more force to be exerted.

Other types of preference control mechanisms are operatively connected to the back of a chair or to a tilt mechanism of the chair to adjust the extent to which the back of the chair may be reclined. Such mechanisms may set a limit that defines a most tilted position or may lock the tilted position of a backrest.

Due to the design of some preference control mechanisms, damage to the preference control mechanism or other portion of a chair may be caused by a user attempting to readjust the preference setting while the chair back is reclined. Indeed, some preference control designs are configured to only permit such adjustment when a chair component is in an upright position or a non-tilted position to prevent such damage.

Some preference control mechanisms are configured to act directly on a tilt spring to adjust the force exerted by that spring to bias the back of the chair to an upright position. For chairs configured to have their seat and backs synchronously tilt, one or more tilt springs may be configured to bias the back and seat of the chair to their respective upright positions. Typically, preference control mechanisms that adjust the force provided by the tilt springs include one or more members that engage or act on the one or more tilt springs. In some cases, the one or more preference control members may break when their positions are adjusted while the back or seat of a chair is in a reclined position due to the tension of the one or more tilt springs.

A device is needed to prevent damage from occurring during preference control adjustment of the biasing force exerted by a chair tilt mechanism. Preferably, the device is configured to permit adjustment even when the back or seat of a chair is in a reclined position without causing damage to the preference control mechanism or the chair.

SUMMARY OF THE INVENTION

A preference control mechanism is provided that includes a housing, a shuttle, a sub shuttle and at least one resilient member. The housing is sized and configured for attachment to at least one chair component and has a channel. The shuttle has a cavity. The shuttle is moveable within the channel of the housing. The sub shuttle is also moveable within the channel of the housing and is moveable independent of the shuttle. The one or more resilient members have a first end and a second end opposite the first end. The first end is attached to the shuttle and the second end is attached to the sub shuttle.

In some embodiments of the preference control mechanism, the sub shuttle is moveable from a first position located substantially within the cavity to a second position located at least partially out of the cavity. A greater portion of the sub shuttle extends out of the cavity when the sub shuttle is in the second position than in the first position.

Preferably, the at least one resilient member is a spring or an elastomeric member. Of course, the at least one resilient member may also be other resilient devices, such as multiple springs, multiple elastomeric members, multiple coil springs, or other resilient apparatuses.

In certain embodiments of the preference control mechanism, the preference control mechanism may also include an actuator and an elongated member. The actuator may be configured for attachment to at least one chair component. Preferably, the actuator is configured for attachment to a chair seat component or a chair base component. The actuator can be moveable from a first position to at least one second position. The elongated member extends from the actuator to the sub shuttle. The elongated member is attached to the actuator such that the movement of the actuator from the first position to the second position causes the elongated member to move from a first position to a second position. The body of the actuator may be configured such that a portion of the body is rotatable so that rotation of the portion of the body can move the actuator from the first position of the actuator to the second position of the actuator. Rotation of the portion of the body may also cause the elongated member to move within the opening of the body.

Preferably, the elongated member is a flexible elongated member, a wire, a cable, or a chain. The elongated member may include a first end that is opposite a second end and the actuator may include a body that has an opening sized to moveably receive the first end of the elongated member such that the first end of the elongated member can move within the opening of the body.

In some embodiments of the preference control mechanism, the shuttle includes a body that defines the cavity of the shuttle and a member attached to the body. The first end of the one or more resilient members can be attached to shuttle adjacent to the member. Preferably, the member is a rod or pin.

Preferably, the one or more resilient members are moveable from a first position to a second position. When in the first position, the one or more resilient members may have a first length. When in the second position, the one or more resilient members may have a second length that is longer than the first length.

The sub shuttle may be attached to the second end of the elongated member such that movement of the actuator from the first position to the second position causes the sub shuttle to move from a first position to a second position. The at least one resilient member can be configured to help bias the sub shuttle to its first position.

Preferably, the shuttle is configured for attachment to a pivot point of at least one chair component. The at least one chair component may be a seat component, a back component, a tilt mechanism component or the housing of the preference control mechanism.

Certain embodiments of the preference control mechanism may also include at least one biasing mechanism. The at least one biasing mechanism is at least partially positioned within the channel and can have one end attached to the sub shuttle and a second end, which is opposite to the first end of the at least one biasing mechanism, attached to the housing. Preferably, the at least one biasing mechanism is a coil spring configured to bias the sub shuttle to a first position that is at least partially within the cavity of the shuttle.

A chair is also provided that include a preference control mechanism. The preference control mechanism is attached to at least a portion of a tilt mechanism of the chair and is sized and configured to permit adjustment of the tilt mechanism. The adjustment to the tilt mechanism may be made while at least one of the chair back and chair seat are in a reclined position such that the adjustment made to the tilt mechanism is effected after the seat and/or back of the chair are moved from the reclined position to the upright position. The adjustment may alter the amount of force required to recline a chair component or can set a limit on the extent to which a chair component may tilt or recline.

Additionally, a chair is provided herein that includes a base, a seat, a back and a tilt mechanism. The tilt mechanism is attached to at least one of the seat, the base and the back. The back is attached to at least one of the seat, the base and the tilt mechanism. The seat is attached to at least one of the base, the tilt mechanism and the back. The chair also includes a preference control mechanism attached to at least a portion of the tilt mechanism. The preference control mechanism includes a housing, a shuttle, a sub shuttle and at least one resilient member. The housing has a channel. The shuttle has a cavity and is moveable within the channel of the housing. The sub shuttle is also moveable within the channel of the housing and is moveable independent of the shuttle. The at least one resilient member has a first end and a second end opposite the first end. The first end is attached to the shuttle and the second end is attached to the sub shuttle.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of the preference control mechanism are shown in the accompanying drawings and certain present preferred methods of practicing the same are also illustrated therein, in which.

DETAILED DESCRIPTION OF PRESENT PREFERRED EMBODIMENTS

Figure 1:
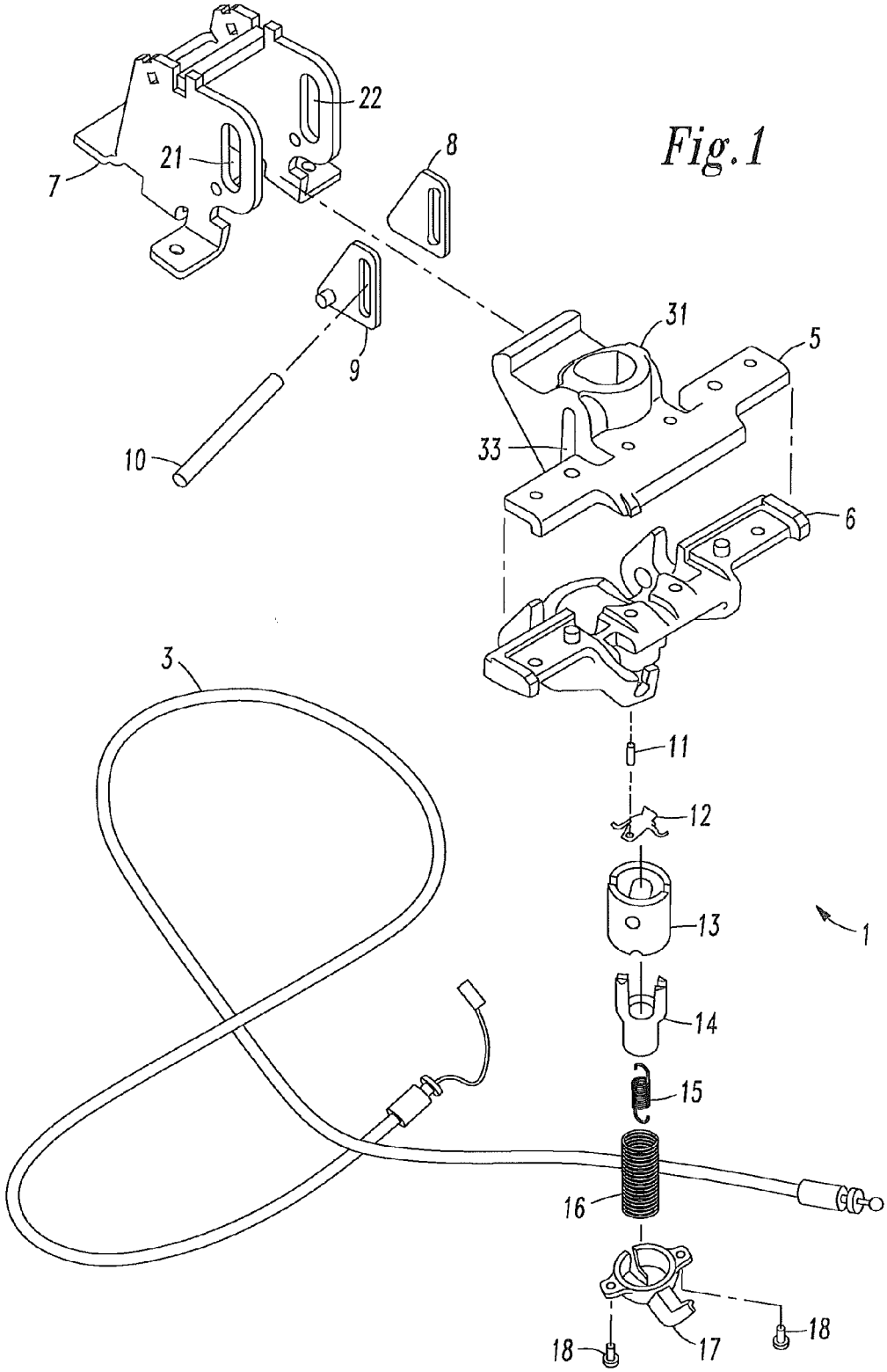
FIG. 1 is an exploded view of a first present preferred embodiment of the preference control mechanism.
Figure 2:
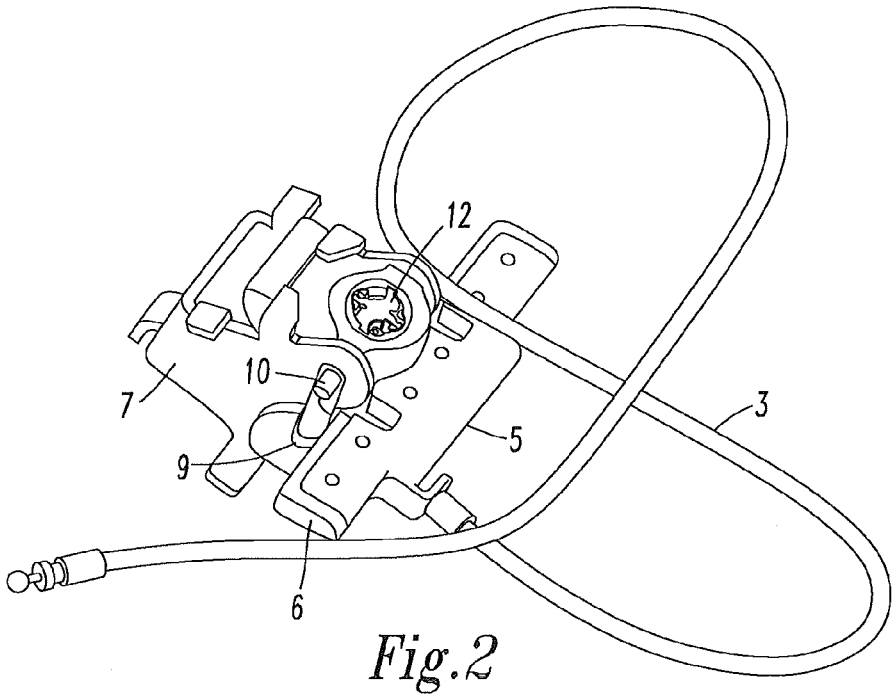
FIG. 2 is a perspective view of the first present preferred embodiment of the preference control mechanism.
Figure 3:
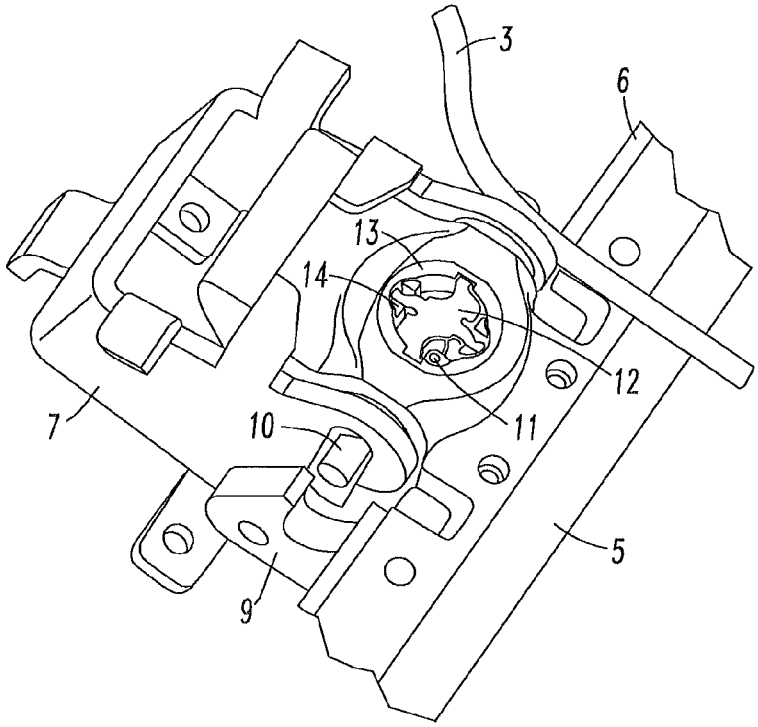
FIG. 3 is a top perspective view of a portion of the first present preferred embodiment.
Figure 4:
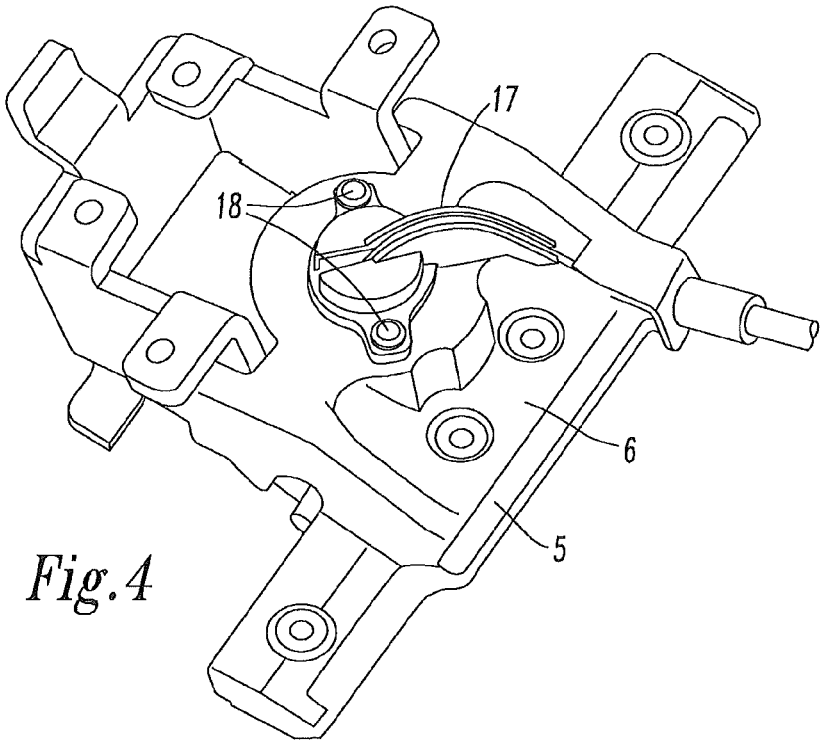
FIG. 4 is a bottom perspective view of a portion of the first present preferred embodiment.
Figure 5:
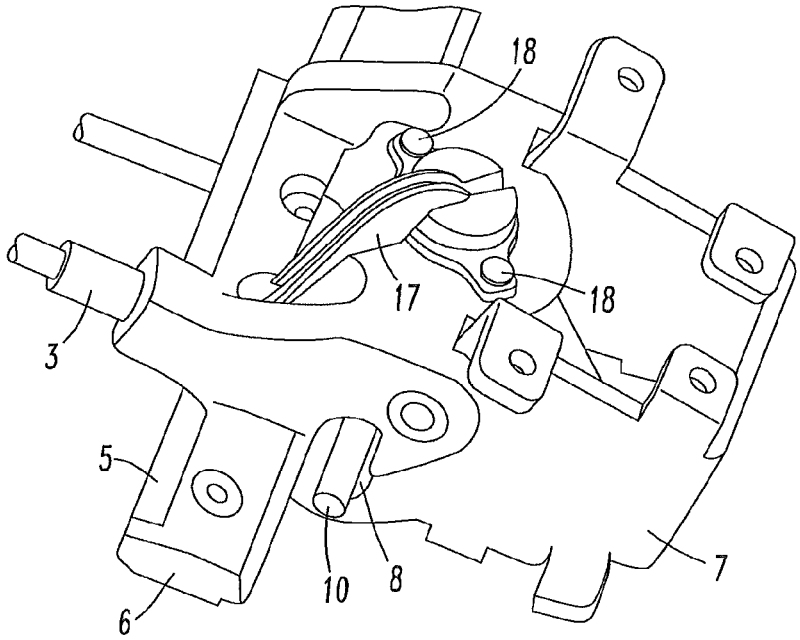
FIG. 5 is a bottom perspective view of a portion of the first present preferred embodiment.
Figure 6:
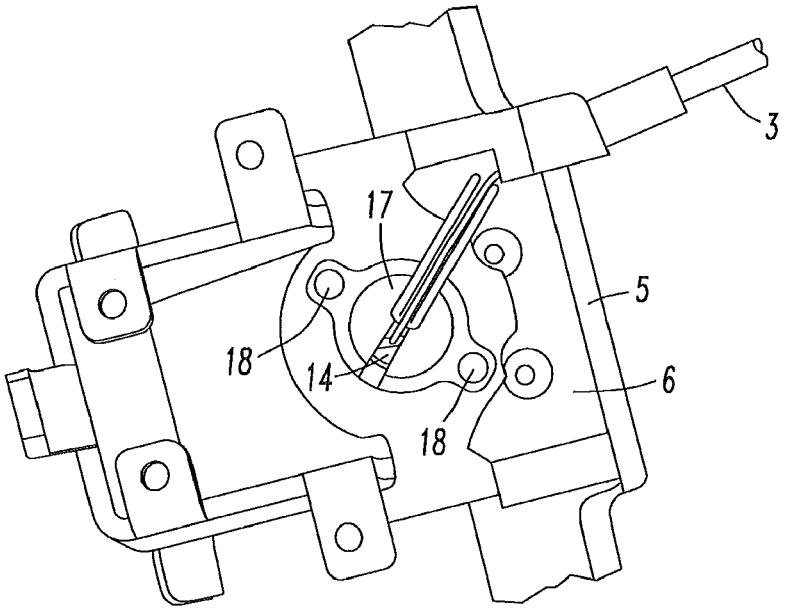
FIG. 6 is a bottom perspective view of a portion of the first present preferred embodiment.

Embodiments of a new and improved preference control system that provides for allowing a preference control selection by a user regardless of whether a component is in a tilted position or not is disclosed herein. Referring to FIGS. 1-10, a preference control mechanism 1 includes a housing composed of a first portion 5 fastened to a second portion 6. The first and second portions 5 and 6 are attached to a third portion 7 of the housing. The third portion 7 of the housing may be a yoke that is sized and configured for attachment to a chair base or a portion of a seat support. The third portion 7 has a slot 21 and 22 on each side of the portion 7. A wear plate 8 is attached to the third portion 7 adjacent slot 22. The wear plate 8 has a slot and is attached to the third portion 7 so the slot of the wear plate 8 aligns with the slot 22. A wear plate 9 is also attached to the third portion 7 and has a slot that is aligned with slot 21 in the third portion 7 of the housing. Preferably, the housing and wear plates are composed of plastic or polymeric material, such as, for example, Hytrel® elastomeric material manufactured by E. I. du Pont de Nemours and Company, or metal.

A bottom portion 17 of the housing is fastened to the second portion 6 of the housing by screws 18, bolts, or other fastening devices or attachment mechanisms. The bottom portion 17 has a holes sized and configured to receive a portion of an elongated member 3 such that the elongated member may travel into or out of a channel 31 defined in the housing. The elongated member 3 may be, for example, a wire, a cable, a flexible elongated member, or a chain.

The first portion 5 of the housing, second portion 6 of the housing and bottom portion 17 of the housing define a channel 31 that is elongated in a vertical direction. The first portion 5 also has a slot 33 on two sides of the channel 31 such that the slots 33 are opposite each other. The slots 33 are aligned with slots 21 and 22 and the slots formed in the wear plates 8 and 9. A rod 10 is positioned through the slots 21 and 22, the slots in the wear plates 8 and 9, slots 33 and channel 31. Preferably, the rod 10 is composed of metal.

The rod 10 is retained in a shuttle 13. The shuttle 13 defines a cavity within the shuttle 13. Preferably, the shuttle 13 is attached to a plate 12 that covers a portion of the shuttle 13.

The rod 10 is moveable within the channel 31. The wear plates 8 and 9 are configured to permit the movement of the rod along the slots 21 and 22 to occur with less friction than if the rod 10 contacted the third portion of the housing 7 while moving along slots 21 and 22. The ends of the rod 10 preferably project beyond the slots 21 and 22.

The shuttle 13 is also moveable within the channel 31 and is attached to the rod 10 such that the shuttle 13 moves when the rod 10 moves. A sub shuttle 14 is also positioned within the channel 31 and is configured for movement into and out of the cavity defined in the shuttle 13. The shuttle 13 is moveable independent of the sub shuttle 14 and the sub shuttle 14 is moveable independent of the shuttle 13. Preferably, the sub shuttle 14 is configured to telescope into or out of the cavity defined in the shuttle 13.

A spring 15 has a first end attached to a portion of the shuttle 13 adjacent the rod 10 and a second end attached to the sub shuttle 14. An elongated member 3 is attached to the sub shuttle 14 and is configured to move such that movement of the elongated member 3 can move the sub shuttle 14 within the channel 31. It should be appreciated that the spring 15 may be replaced with one or more resilient members such as, for example, one or more elastomeric members, in alternative embodiments.

A coil spring 16 is attached between an end of the sub shuttle 14 and an end of the bottom of the housing 17. The spring 16 is configured to bias the sub shuttle 14 in an upward direction and bias the sub shuttle 14 and shuttle 13 in the first position illustrated in FIG. 8. It should be appreciated that the coil spring 16 may be replaced with one or more resilient members such as, for example, one or more elastomeric members, or one or more biasing mechanisms in alternative embodiments.

Figure 8:
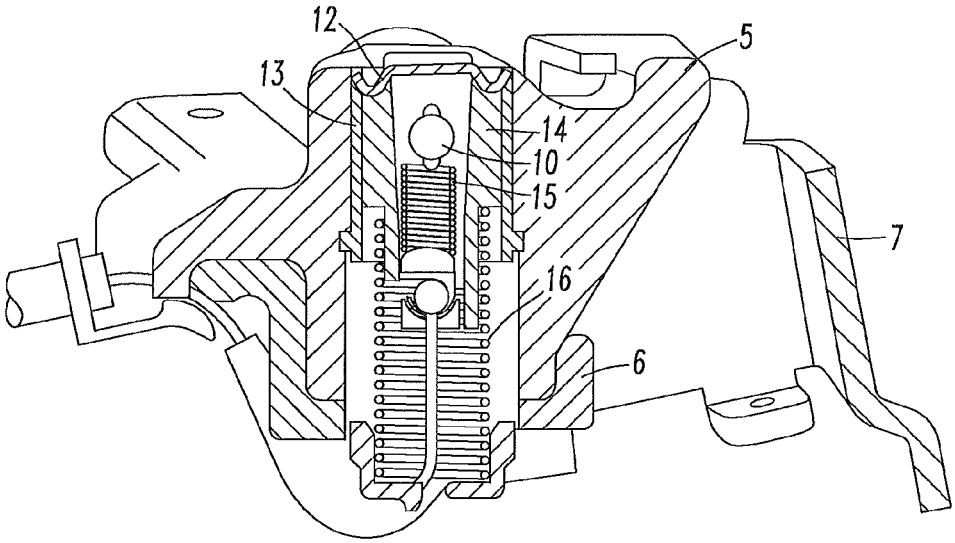
FIG. 8 is a cross sectional view of the first present preferred embodiment illustrating the rod, shuttle, and sub shuttle in a first position.
Figure 9:
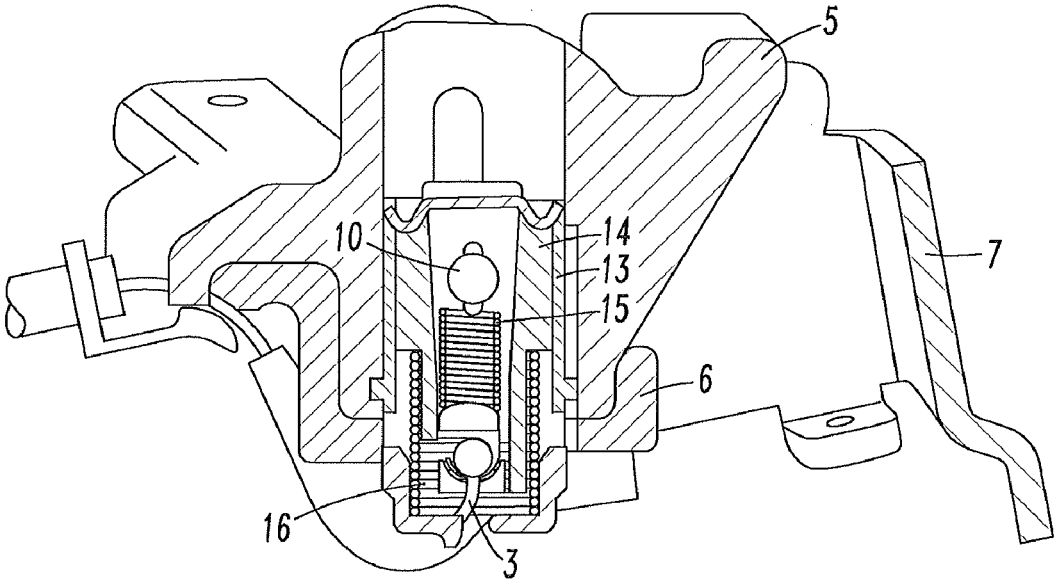
FIG. 9 is a view similar to FIG. 8 of the first present preferred embodiment illustrating the rod, shuttle, and sub shuttle in a second position.
Figure 10:
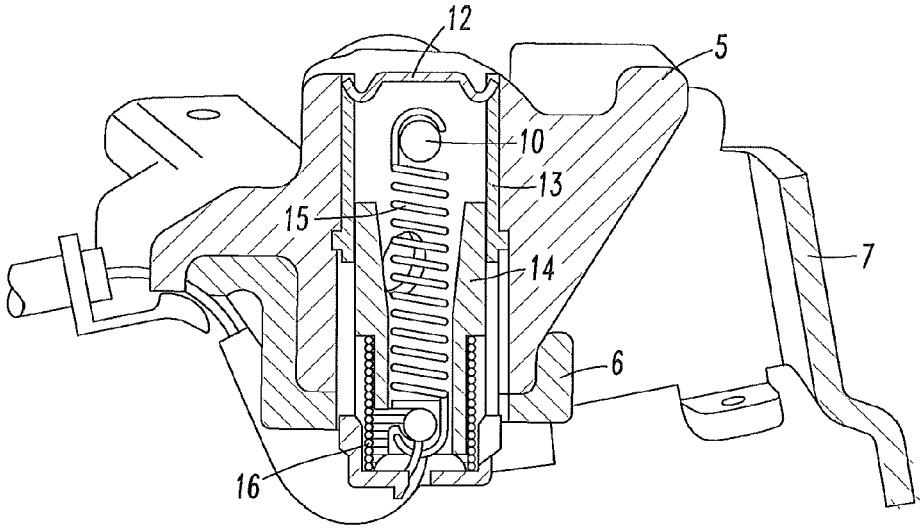
FIG. 10 is a view similar to FIGS. 8 and 9 of the first present preferred embodiment illustrating the rod and shuttle in the first position and the sub shuttle in the second position.

As may be appreciated from FIGS. 8-10, the position of the rod 10 may be changed from a first position, which is shown in FIG. 8, to at least one other position such as the second position shown in FIG. 9. Of course, the rod 10 may also be moved from the second position to the first position. Preferably, the rod 10 is moveable from a first position to multiple different positions.

An actuator 41 is attached to an end of the elongated member 3 and is configured to move the elongated member to multiple different positions within a channel 43 defined in the actuator 41. The different positions of the elongated member 3 within the channel 43 may be defined by detents that permit the lever of the actuator 41 to snap into any of the possible selectable positions. The actuator 41 may be positioned adjacent to a component of a chair, such as an armrest, seat, or pedestal. Preferably, the actuator 41 is positioned adjacent the seat of the chair and is configured to permit a user to select at least four different preference settings, which correspond to different positions of the rod 10 and shuttle 13 within the channel 31. Actuation of the actuator 41 moves the elongated member 3 to a selected position within the channel 31, which also helps move the position of the rod 10 to adjust the preference setting.

Figure 8A:
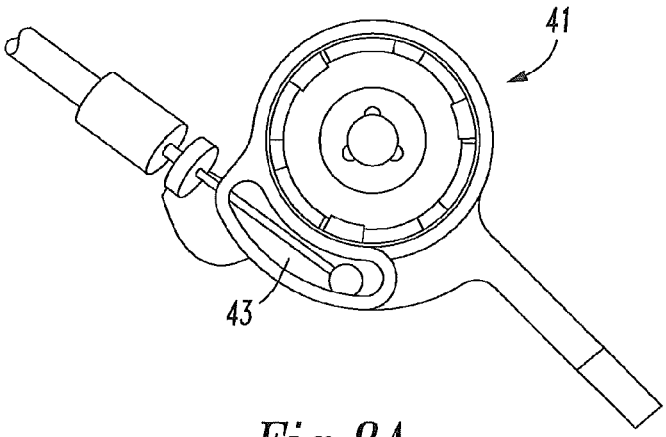
FIG. 8A is a cross sectional view of the first present preferred embodiment illustrating the actuator of the mechanism in a first position
Figure 9A:
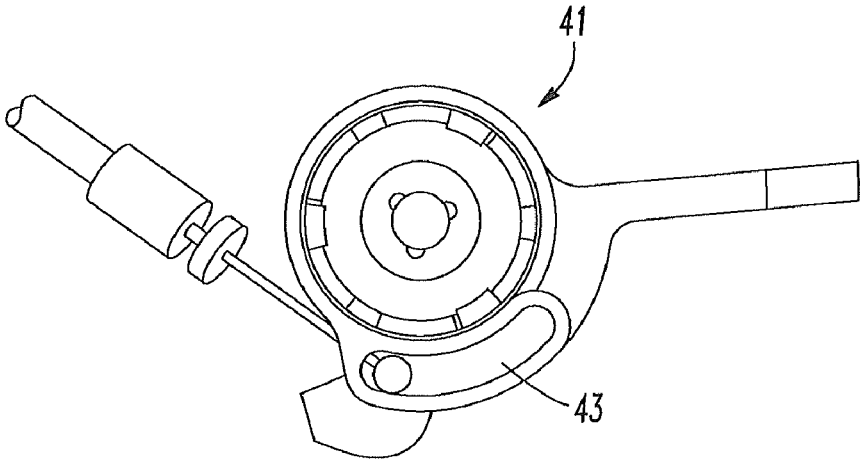
FIG. 9A is a cross sectional view similar to FIG. 8A of the first present preferred embodiment illustrating the actuator of the mechanism in a second position.

Movement of the elongated member 3 by the actuator 41 causes the sub shuttle 14 to move along the channel 31. If the rod 10 is not prevented from movement, such motion can cause the shuttle to also move to the selected position. For example, movement of the elongated member 3 from a first position, which corresponds to the position shown in FIG. 8A to a second position, which corresponds to the position shown in FIG. 9A, can cause the sub shuttle 14 and shuttle 13 to move from the first position shown in FIG. 8A to the second position shown in FIG. 9A.

However, if a force is acting on rod 10 that prevents rod 10 from movement, movement of the actuator 41 from the first position to the second position may still move the sub shuttle 14 from the first position to the second position, as may be appreciated from FIG. 10. It should be appreciated that forces that could prevent rod 10 from moving may include a force exerted by a user to recline the back and/or seat of a chair or be due to the seat or back of a chair being in a reclined position.

Movement of the actuator 41 from one position to a second position causes the elongated member 3 to move from a first position to a second position. Movement of the elongated member 3 causes the sub shuttle 14 to move from the first position to the second position. Because rod 10 is prevented from movement, the rod 10 and shuttle 13 remain in the first position. The spring 15, however, exerts a force on the rod 10 and the shuttle so that once the force acting on the rod 10 is removed, the rod 10 and shuttle 13 move to the second position. The force may be removed when the seat or back of a chair is moved to an upright position or when a user stops providing a recline force to the back or seat. Since rod 10 is not required to move if prevented from doing so upon actuation of actuator 41, damage to the preference control mechanism or other components can be averted in the event a user attempts to adjust the preference control mechanism when the rod 10 is unable to move.

It should be appreciated that the rod 10 can be configured to extend beyond slots 21 and 22 of the third housing portion 7 to define a pivot point for connecting to a chair component, such as, for example, a back or seat. In one embodiment, a chair back or back frame is configured to attach to the rod 10 on opposite ends of the rod 10 and pivot about the rod 10 when a user reclines the back. In yet another embodiment, opposite ends of a seat or seat frame may be attached to opposite ends of the rod 10 such that the seat may pivot about the rod 10 during movement of the seat. Such movement could include rearward or forward tilting of the seat. In yet other embodiments, both a back and seat of a chair could be pivotally connected to each end of the rod 10 such that both the seat and back may pivot along the rod 10 during movement of the seat and/or back. Such seat and back movement may be configured to be synchronous and/or independent.

The vertical adjustment of the rod 10 that occurs when the rod is moved along the vertically elongated channel 31 and slots 33 can also adjust the mechanical advantage provided for tilting or moving the chair component so that such movement requires more or less force from a user. Positioning the actuator at one of the selectable positions may then adjust the ease or difficulty with which one or more components are moved by a user. For instance, a user may adjust the setting of the rod 10 so that tilting of the back, seat, or both is easier or harder to do. Such adjustment can permit very heavy users to enjoy the same seating experience as lightweight users by adjusting the preference control mechanism so that a greater amount of force is needed to tilt one or more chair components pivotally connected to the rod 10. Similarly, a lightweight user may enjoy the same ride as a heavy user by adjusting the preference control mechanism so that a lesser amount of force is needed to tilt or otherwise move one or more chair components pivotally attached to the rod 10.

In some embodiments of the preference control mechanism, the housing may include projections or have one or more portions that define one or more grooves or openings sized and configured to engage or interlock with other structures. For example, such protrusions and/or openings and/or grooves may be configured to interlock with or engage one or more portions of a seat support, seat frame or back frame. Such openings, grooves and/or projections can permit the preference control mechanism to transfer at least a portion of the force one or more components that may be connected to the rod 10 may exert on the rod 10 and permit the preference control mechanism to be more securely attached to a seat support or other chair component. Because a portion of this force is transferred to other structures, the housing and other components of the preference control mechanism may be composed of less costly and weaker materials without detracting from the durability and/or reliability of the preference control mechanism.

Figure 7:
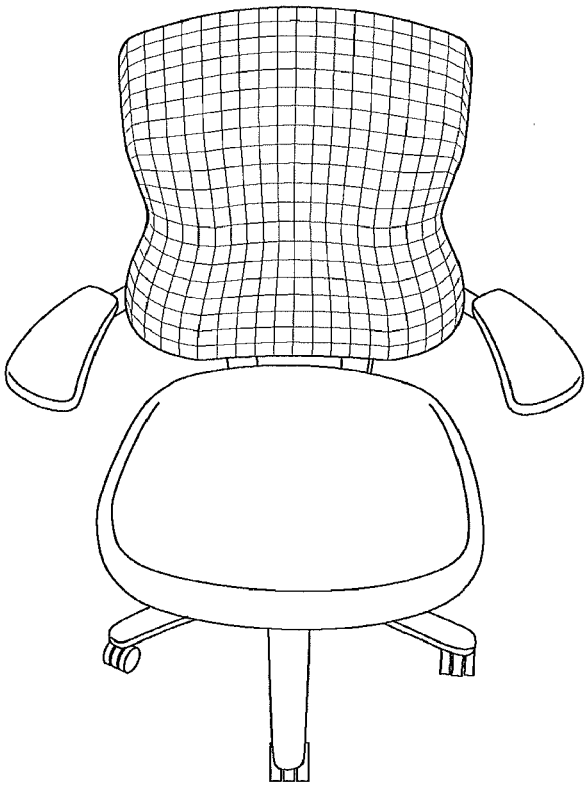
FIG. 7 is a perspective view of a chair that includes the first present preferred embodiment positioned within the housing of the seat support of the chair.

As may be appreciated from FIG. 7 and the above, the preference control mechanism 1 may be part of a chair. The chair may be configured in a number of different configurations. For example, the chair could be configured so the seat and back synchronously tilt or so that only the back tilts. The back of the chair may be attached to the base, seat and/or tilt mechanism of the chair. The seat may be attached to the base, back, and/or tilt mechanism of the chair. Similarly, the tilt mechanism may be attached to the base, seat and/or back of the chair.

The preference control mechanism may be attached to a chair seat, chair back, tilt mechanism, and/or chair base. For instance, the preference control mechanism may be positioned within a support structure configured to support a seat and/or back of a chair on a base or pedestal. A portion of the preference control mechanism, such as an actuator, may be positioned below or adjacent to a seat portion of the chair or the base of the chair. Preferably, the preference control is configured to adjust the mechanical leverage applied by a tilt control mechanism of a chair during recline of the seat and/or back of the chair.

For example, it should be understood that the rod 10 of the preference control mechanism may be a portion of a pivot point or pivoting axle for a seat or back. Such a rod may be a portion of the tilt mechanism of the chair. Movement of the rod 10 can be configured to adjust the mechanical leverage for a user reclining the back of a chair. The preference control may also be configured to interact with a tilt spring. For instance, a portion of rod 10 may be configured to engage one or more tilt springs. Adjustment of the position of the rod 10 can adjust the tension setting of the one or more tilt springs. In other embodiments, the preference control mechanism can be configured so movement of the rod 10 provides a limit setting that is configured to engage a tilt spring or other portion of a tilt mechanism to limit the extent of back recline or seat recline the tilt spring may permits.

It should be appreciated that other variations of the present preferred embodiments discussed above may be made. For example, embodiments of the preference control mechanism can include a channel 31 and slots 21, 22 and 33 that are slanted so that the slots and channel are elongated in both vertical and horizontal directions. The channel 31 and slots 21, 22 and 33 may also only be elongated horizontally such that movement of the shuttle and sub shuttle is only horizontal movement. As another example, the first, second and third housing portions may form a unitary structure. As yet another example, the shuttle 13 may be integral with the top plate 12 so the top plate 12 and shuttle 13 form a unitary structure. As yet another example, embodiments of the preference control mechanism may utilize more than one spring or resilient member between the shuttle and sub shuttle. As an additional example, different actuation mechanisms may be used to actuate the preference control mechanism.

Figure 12:
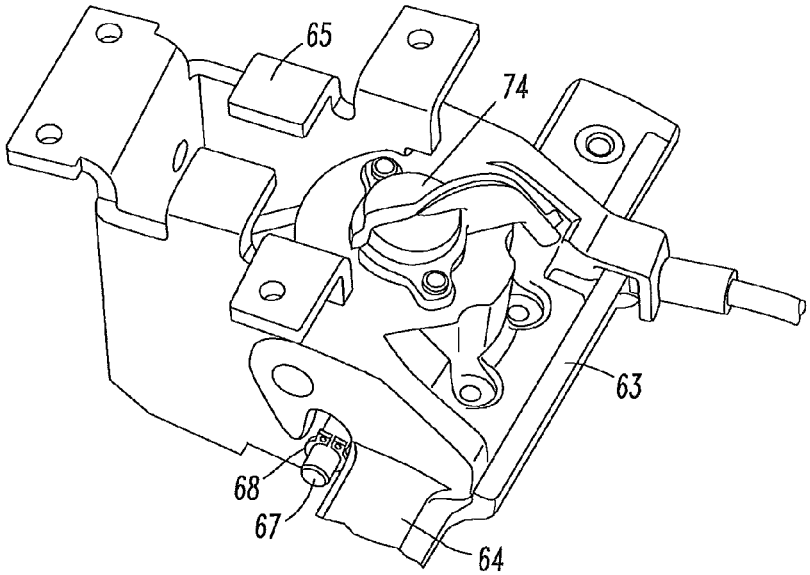
FIG. 12 is a bottom fragmentary view of the second present preferred embodiment of the preference control mechanism.
Figure 11:
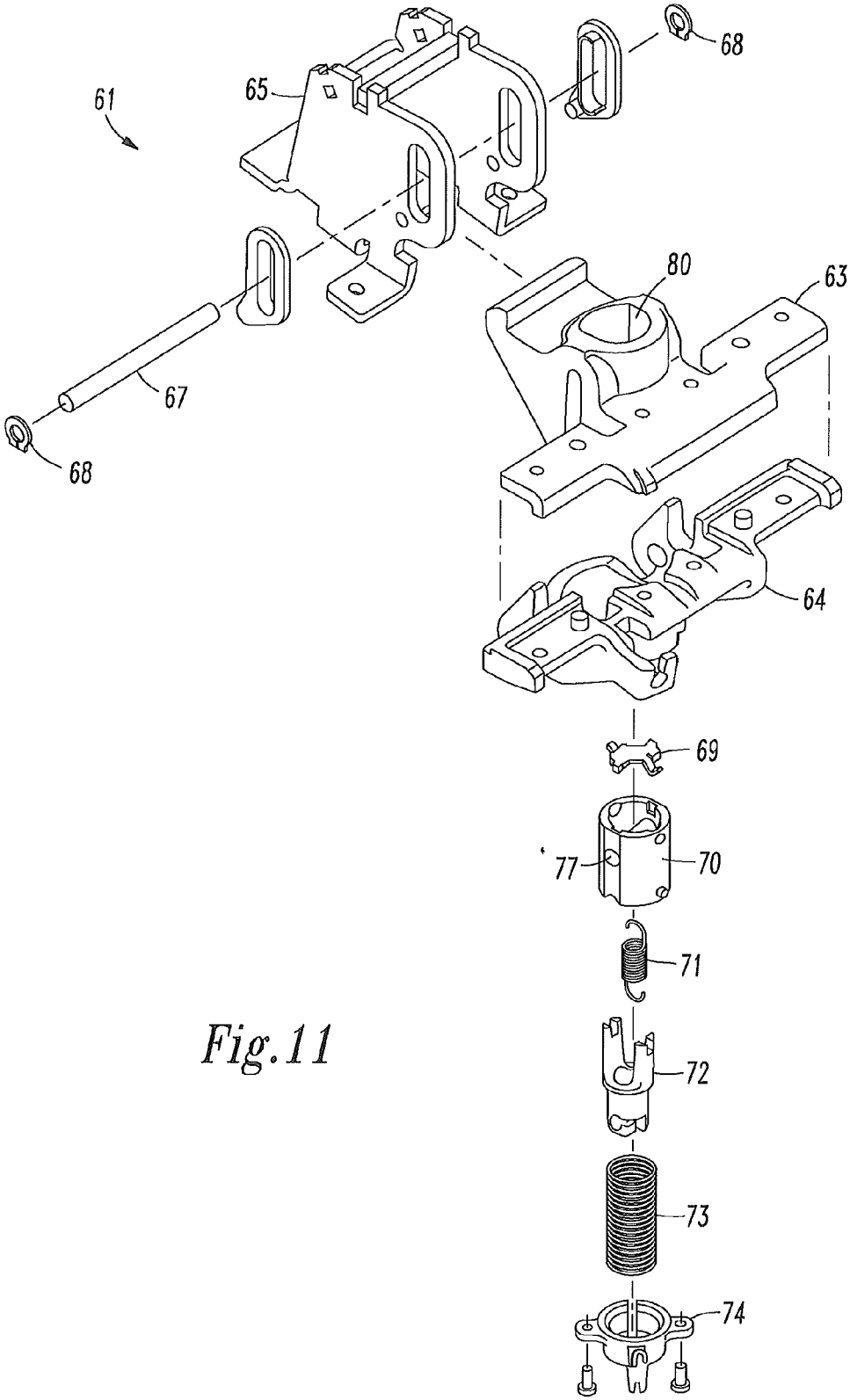
FIG. 11 is an exploded view of a second first present preferred embodiment of the preference control mechanism.

A second present preferred preference control mechanism 61 is shown in FIGS. 11 and 12. The preference control mechanism 61 includes a housing that has a yoke portion 65, a top portion 63, and intermediate portion 64 and a bottom portion 74. A plate 69 is attached to a shuttle 70 that is moveable within a channel 80 formed in the top and intermediate housing portions. A sub shuttle 72 is moveably positioned within an opening of the shuttle 70 and the channel 80 at least partially defined by the top and intermediate housing portions 63 and 64. A coil spring 73 is positioned between the bottom portion 74 of the housing and the sub shuttle 72. A coil spring 71 is also attached between the shuttle 70 and sub shuttle 72. A member 67 extends through slots that communicate with the channel 80 and through an opening 77 formed in the shuttle 70. The slots preferably define three different positions at which the member 67 may be positioned. Such positions may be defined by teeth or projections the project partially into the slot.

Clips 68 are attached to opposite sides of the member 67. The clips 68 are preferably resilient and are attached adjacent to the ends of the member 67 to engage the sides of the housing adjacent to the slots to help position the member 67 into a particular position defined by the slots.

Preferably, the ends of the member 67 define an axis of rotation for a chair back or chair seat component. Movement of the member 67 may adjust the amount of force necessary to tilt, rotate or move that seat or back component.

Actuation and movement of the sub shuttle 72 and shuttle 70 may be performed similarly to the sub shuttle and shuttle of the first present preferred embodiment discussed above. For instance, an elongated member may be attached to the sub shuttle 72 and may be moved to adjust the position of the member 67.

While certain present preferred embodiments of the preference control mechanism and certain embodiments of methods of practicing the same have been shown and described, it is to be distinctly understood that the invention is not limited thereto but may be otherwise variously embodied and practiced within the scope of the following claims.

What is claimed is:

1. A chair comprising:

a base, a seat, a back, and a tilt mechanism;

the tilt mechanism attached to at least one of the seat, the base and the back;

the back attached to at least one of the seat, the base and the tilt mechanism;

the seat attached to at least one of the base, the tilt mechanism and the back;

the chair also comprising a preference control mechanism attached to at least a portion of the tilt mechanism, the preference control mechanism sized and configured to permit adjustment of the tilt mechanism to adjust an amount of force needed to tilt at least one of the back and the seat while the at least one of the back and the seat are in a reclined position such that the adjustment made to the tilt mechanism is effected after the at least one of the back and the seat are moved from the reclined position to an upright position.

2. The chair of claim 1 wherein the preference control mechanism only adjusts an amount of force needed to tilt the back.

3. The chair of claim 1 wherein the preference control mechanism only adjusts the amount of force needed to tilt the seat.

4. The chair of claim 1 wherein the preference control mechanism adjusts the tilt mechanism to adjust an amount of force needed to tilt the at least one of the back and the seat tilt mechanism by adjusting a mechanical advantage provided for tilting the at least one of the seat and the back.

5. The chair of claim 4 wherein the preference control mechanism is comprised of a mechanism for adjusting a position of a member of the tilt mechanism, the member attached to the at least one of the seat and the back such that the at least one of the seat and the back rotate about the member to move from the upright position to the reclined position.

6. The chair of claim 5 wherein the preference control mechanism moves the member vertically to adjust the position of the member of the tilt mechanism.

7. The chair of claim 1 wherein the preference control mechanism is comprised of a shuttle and a sub shuttle that is moveable within a cavity of the shuttle.

8. A chair comprising:

a base;

a seat;

a back;

a tilt mechanism for tilting at least one of the seat and the back, the tilt mechanism attached to base and also attached to at least one of the seat and the back;

the back attached to at least one of the seat, the base and the tilt mechanism;

the seat attached to at least one of the base, the tilt mechanism and the back; and a preference control means for adjusting the tilt mechanism to adjust an amount of force needed to tilt at least one of the back and the seat while at least one of the back and the seat are in a reclined position such that the adjustment made to the tilt mechanism is effected after the at least one of the back and the seat are moved from the reclined position to an upright position.

9. The chair of claim 8 wherein the preference control means only adjusts an amount of force needed to tilt the back.

10. The chair of claim 8 wherein the preference control means only adjusts an amount of force needed to tilt the seat.

11. The chair of claim 8 wherein the preference control means is configured such that adjustment of the tilt mechanism adjusts a mechanical advantage provided for tilting the at least one of the seat and the back.

12. The chair of claim 11 wherein the tilt control mechanism is comprised of a member attached to the at least one of the seat and the back such that the at least one of the seat and the back rotate about the member to move from the upright position to the reclined position.

13. The chair of claim 12 wherein the preference control means moves the member vertically to adjust the position of the member of the tilt mechanism.

14. The chair of claim 12 wherein the member of the tilt mechanism is a rod.

15. The chair of claim 8 further comprising actuator means for actuating the preference control means to adjust the tilt mechanism to adjust an amount of force needed to tilt at least one of the back and the seat.

16. The chair of claim 8 wherein the seat is attached to the back and to the tilt mechanism and the back is attached to the seat.

17. The chair of claim 8 wherein the tilt mechanism is attached to the seat and is also attached to the back.

18. The chair of claim 8 wherein the seat is attached to the back and to the tilt mechanism and the back is attached to the base.

19. The chair of claim 18 wherein the preference control means is comprised of a shuttle and a sub shuttle that is moveable within a cavity of the shuttle.

* * * * *